US009683315B2

(12) United States Patent
Schmitt et al.

(10) Patent No.: US 9,683,315 B2
(45) Date of Patent: Jun. 20, 2017

(54) FLAME RESISTANT YARNS AND FABRICS INCLUDING PARTIALLY AROMATIC POLYAMIDE FIBER AND OTHER FLAME RESISTANT FIBERS

(75) Inventors: Thomas E. Schmitt, Concord, NC (US); Deborah M. Sarzotti, Kingston (CA)

(73) Assignee: INVISTA NORTH AMERICA SARL, Wilmington, DE (US)

( * ) Notice: Subject to any disclaimer, the term of this patent is extended or adjusted under 35 U.S.C. 154(b) by 480 days.

(21) Appl. No.: 14/342,292

(22) PCT Filed: Aug. 30, 2012

(86) PCT No.: PCT/US2012/053022

§ 371 (c)(1),
(2), (4) Date: Apr. 3, 2014

(87) PCT Pub. No.: WO2013/074181

PCT Pub. Date: May 23, 2013

(65) Prior Publication Data

US 2014/0208491 A1 Jul. 31, 2014

Related U.S. Application Data

(60) Provisional application No. 61/530,434, filed on Sep. 2, 2011.

(51) Int. Cl.
*D02G 3/44* (2006.01)
*A41D 31/00* (2006.01)

(52) U.S. Cl.
CPC ..... *D02G 3/443* (2013.01); *A41D 31/0022* (2013.01); *D10B 2201/20* (2013.01); *D10B 2331/021* (2013.01); *Y10T 442/2631* (2015.04)

(58) Field of Classification Search
CPC ..... D02G 3/443; A41D 31/022
USPC ..... 442/197, 301
See application file for complete search history.

(56) References Cited

U.S. PATENT DOCUMENTS

| | | | | |
|---|---|---|---|---|
| 5,043,207 | A | 8/1991 | Donovan et al. | |
| 5,906,891 | A * | 5/1999 | Shida | D01F 6/90 264/172.18 |
| 2005/0025962 | A1 | 2/2005 | Zhu et al. | |
| 2005/0025963 | A1 | 2/2005 | Zhu | |
| 2005/0119379 | A1 | 6/2005 | Martens et al. | |
| 2008/0057807 | A1* | 3/2008 | Tutterow | A41D 31/0022 442/1 |
| 2008/0139752 | A1 | 6/2008 | De Schryver et al. | |
| 2008/0182470 | A1* | 7/2008 | Fang | D02G 3/443 442/146 |
| 2010/0210162 | A1 | 8/2010 | Li et al. | |
| 2013/0244527 | A1 | 9/2013 | Sarzotti et al. | |

FOREIGN PATENT DOCUMENTS

| | | | |
|---|---|---|---|
| CN | 101263253 | A | 9/2008 |
| CN | 101326315 | A | 12/2008 |
| CN | 101657573 | A | 2/2010 |
| EP | 0330163 | A2 | 8/1989 |
| EP | 0364194 | A2 | 4/1990 |
| EP | 1498522 | B1 | 9/2010 |
| FR | 2514934 | A1 | 4/1983 |
| FR | 2691721 | A1 | 12/1993 |
| JP | 01-221537 | A | 9/1989 |
| JP | 04-501221 | A | 3/1992 |
| JP | 10-88448 | A | 4/1998 |
| JP | 2007-500802 | A | 1/2007 |
| JP | 2007-500803 | A | 1/2007 |
| JP | 2007-507595 | A | 3/2007 |
| JP | 2008-031618 | A | 2/2008 |
| JP | 2011-502218 | A | 1/2011 |
| JP | 2013-542334 | A | 11/2013 |
| KR | 93-9831 | B1 | 10/1993 |
| RU | 2402648 | C1 | 10/2010 |
| WO | 93/24690 | A1 | 12/1993 |
| WO | 2004/005606 | A1 | 1/2004 |
| WO | 2005/033192 | A1 | 4/2005 |
| WO | 2007/133177 | A2 | 11/2007 |
| WO | 2008/027454 | A1 | 3/2008 |
| WO | 2011/056467 | A2 | 5/2011 |
| WO | 2012/040332 | A2 | 3/2012 |
| WO | 2013/074181 | A2 | 5/2013 |

OTHER PUBLICATIONS

Extended Search Report Received for European Patent Application No. 12849818.5, mailed on Oct. 26, 2015, 7 pages.
International Preliminary Report on Patentability received for PCT Patent Application No. PCT/US2012/053022, mailed on Mar. 13, 2014, 5 pages.
International Search Report and Written Opinion received for PCT Patent Application No. PCT/US2012/053022, mailed on Jun. 18, 2013, 6 pages.
Cotton Incorporated, "Fabric Flame Retardant Treatment 'Precondensate' /NH3 Process," Technical Bulletin 2003, 12 pages.

* cited by examiner

*Primary Examiner* — Jenna Johnson
(74) *Attorney, Agent, or Firm* — Licata & Tyrrell P.C.

(57) ABSTRACT

Disclosed are technical fibers and yarns made with partially aromatic polyamides and a fiber having vapor phase action such as an FR cellulosic fiber. Fabrics made from such fibers and yarns demonstrate superior flame retardancy over traditional flame retardant nylon 6,6 fabrics. Further, the disclosed fibers and yarns, when blended with other flame retardant fibers, do not demonstrate the dangerous "scaffolding effect" common with flame retardant nylon 6,6 blended fabrics.

28 Claims, No Drawings

FLAME RESISTANT YARNS AND FABRICS INCLUDING PARTIALLY AROMATIC POLYAMIDE FIBER AND OTHER FLAME RESISTANT FIBERS

FIELD OF THE INVENTION

The invention relates to technical fibers, yarns, and fabrics in general, and in particular, to flame retardant fibers, yarns, and fabrics made therefrom including blends of partially aromatic polyamide fibers which exclude flame retardant additives.

BACKGROUND OF THE TECHNOLOGY

Flame retardant and flame resistant (FR) fabrics are crucial in both military and non-military environments. Firefighters, race car drivers, and petro-chemical workers are just a few of the non-military groups that benefit from the added protection of flame retardant fabrics. However, today the true benefit of flame retardant fabrics lies with the military. In addition to the unforgiving surroundings that military troops must operate in, the advent of unconventional modern warfare creates an even more hostile environment. Specifically, the use of improvised explosive devices ("IEDs") to immobilize large convoys of soldiers makes individual troop protection critically important.

In addition to ballistic fabrics and body armor, flame retardant fabrics serve a crucial role in protecting soldiers from IEDs. IEDs are constructed of numerous materials (e.g. high-explosive charges, flammable liquids, shrapnel, etc.), some acting as projectiles and others acting as incendiaries upon detonation. Thus, military fabrics must be of varied construction to handle the multitude of threats from an IED.

There are basically two types of flame retardant fabrics used in protective clothing: (1) Fabrics made from flame retardant organic fibers (e.g. aramid, flame retardant rayon, polybenzimidazole, modacrylic etc.); and (2) Flame retardant fabrics made from conventional materials (e.g. cotton) that have been post treated to impart flame retardancy. Nomex® and Kevlar® aromatic polyamides are among the most common types of flame retardant synthetic fibers. These are made by solution spinning a meta- or para-aromatic polyamide polymer into fiber. Aromatic polyamides do not melt under extreme heat, are naturally flame retardant, but must be solution spun. Unfortunately, Nomex® and KEVLAR® are not very comfortable and are difficult and expensive to produce.

Another fiber used in protective clothing is modacrylic which is fiber comprising 30 to 70 parts by mass of acrylonitrile and 70 to 30 parts by mass of a monomer such as a halogen-containing vinylidene monomer and/or a halogen-containing vinyl monomer. Commercial examples include PROTEX® C and PROTEX® M fibers manufactured by Kaneka. At an approximate 1:1 blend ratio, modacrylic fibers are known to impart flame resistance properties to fabrics comprising non-FR treated cellulosic fibers such as cotton and lyocell. Examples can be found in EP1498522 and WO2008027454.

Cellulose fibers such as acetate, rayon, lyocell, and cotton can be rendered flame resistant by incorporating phosphorus-nitrogen additives at fiber spinning or at fabric finishing.

The mechanisms for flame resistance performance of both modacrylic and flame resistant cellulose rely on gases emitted from the fibers which dilute, cool, or chemically neutralize flammable gases (vapor phase action) and which form intumescent char barriers (condensed phase action).

Post-treatment flame retardants are applied to fabrics and can be broken down into two basic categories: (1) Durable flame retardants; and (2) Non-durable flame retardants. For protective clothing, the treatment must withstand laundering, so only durable treatments are selected. Today, most often, durable flame retardant chemistry relies on phosphorus-based FR agents and chemicals or resins to fix the FR agents to the fibers.

One polymer fiber that has been widely studied because of its processability and strength is nylon 6,6 fiber. A small amount—about 12%—of aliphatic nylon fibers can be blended with cotton in a yarn to produce a fabric; where the yarn and/or the fabric made therefrom is chemically treated to produce a flame retardant fabric. Because cotton is the major fiber component, this fabric may be called "FR cotton" fabric. Nylon fibers impart superior wear resistance to FR cotton fabrics and garments. However, because nylon is melt processable (i.e. thermoplastic) and offers no inherent flame resistance, the quantity of nylon fiber in an FR fabric, such as an FR treated cotton fabric, is limited. Attempts to increase nylon fiber content by chemical modification of aliphatic nylon fibers or development of new flame retarding fabric treatments have been unsuccessful.

SUMMARY OF THE INVENTION

The problem with using blends of thermoplastic fibers with non-melting flame resistant fibers (e.g. aliphatic polyamides and FR treated cotton) is the so-called "scaffolding effect." (See Horrocks et al., *Fire Retardant Materials* at 148, §4.5.2 (2001)). In general, thermoplastic fibers, including those treated or modified with FR agents, self-extinguish by shrinking away from the flame source or when molten polymer drips away from the flame source and extinguishes. FR polyester fiber is a fiber with such behavior. When FR polyester fiber is blended with a non-melting flame retardant fiber, such as FR-treated cotton, the non-melting fiber forms a carbonaceous scaffold and the thermoplastic FR polyester fiber is constrained in the flame and will continue to burn. In essence, during vertical flammability testing, the thermoplastic fiber polymer melts and runs down the non-thermoplastic scrim and feeds the flame and the fabric burns completely. Additionally, in clothing, the molten polymer can drip and stick to human skin and results in additional injuries to the wearer.

What is needed are improved flame retardant yarns which include thermoplastic fibers, which are more easily and cost-effectively prepared. The yarns including the thermoplastic fibers would ideally provide fabrics and garments that eliminate the "scaffolding effect", provide good flame retardancy, prevent molten polymer dripping or sticking, are dyeable, and are wear resistant and comfortable. Therefore, it is desirable to find a combination of melt-processed polymer that can be blended or otherwise combined with at least one other FR fiber to provide a yarn that can be knit or woven or prepared into a nonwoven self-extinguishing, no drip, durable flame retardant fabric, batting, or garment.

One aspect provides an article exhibiting flame resistant or flame retardant property including a primary yarn; where the primary yarn includes a flame resistant or flame retardant (FR) fiber having significant vapor phase action such as modacrylic or FR cellulose fibers and a fiber different from said flame resistant or flame retardant fiber including a partially aromatic polyamide fiber; where the partially aromatic polyamide polymer without FR additives is melt spun into fiber. In other words, the partially aromatic polyamide fiber excludes FR additives, which are integral to the fiber composition. The article may be a yarn. However, the article may also be a fabric or a garment including the flame resistant yarn.

DETAILED DESCRIPTION OF THE INVENTION

The terms "flame resistant," "flame retardant," and "FR" have subtle differences in the art. The differences in the usage of the terms relate to describing fabrics which either resist burning, burn at a slower rate and are capable of self-extinguishing under conditions such as a vertical flame test. For the purposes of this invention the terms "flame resistant" and "flame retardant" are used interchangeably and are meant to include any fabric that possesses one or more of the desired properties such as resistance to burning, slow burning, self-extinguishing, etc.

The term "vapor phase action" for fibers useful in the present invention is meant to include fibers which dilute, cool, or chemically neutralize flammable gases. The mechanisms for flame resistance performance of both modacrylic and flame resistant cellulose rely on gases emitted from the fibers which dilute, cool, or chemically neutralize flammable gases (vapor phase action) and which form intumescent char barriers (condensed phase actions).

The articles, specifically, yarns, fabrics and garments exhibit flame resistant and/or flame retardant properties. The yarns include at least one fiber which is a partially aromatic polyamide. The yarn including the partially aromatic fiber is referred to in the claims as a "primary yarn." The term "primary yarn" is not meant to establish any relative weight percent of yarn in comparison to other yarns that may be present in the article, but instead is used to distinguish the yarn from other yarns. The primary yarn must include a partially aromatic fiber which excludes spun-in FR additives combined with a FR fiber such as a FR cellulose fiber, modacrylic fiber, and mixtures thereof.

The partially aromatic fibers exclude spun-in FR additives. The partially aromatic polyamide may include polymers or copolymers including monomers selected from the group consisting of aromatic diamine monomers, aliphatic diamine monomers, aromatic diacid monomers, aliphatic diacid monomers and combinations thereof. The partially aromatic polyamide can also include or exclusively be MXD6 which includes an aromatic diamine and non-aromatic diacid. Other partially aromatic polyamides can be based upon an aromatic diacid such as terephthalic acid (polyamide 6T) or isophthalic acid (polyamide 6I) or blends thereof (polyamide 6T/6I). The melting, or processing temperatures, of partially aromatic polyamides ranges from about 240° C. (for MXD6) to about 355° C. (for polyamideimide), including about 260° C., 280° C., 300° C., 320° C., and 340° C. Nylon 6 and nylon 6,6 have melting temperatures of about 220° C. and 260° C., respectively. The lower the melting temperature, the easier the polyamide polymer is to process into fiber. Below is a list of common partially aromatic polymers and certain comparative non-aromatics and their associated melting temperatures.

| Polymer | Trade Name | Melting Temperature, ° C. |
|---|---|---|
| Nylon 6 (non-aromatic) | Various | 220 |
| Nylon 66 (non-aromatic) | Various | 260 |
| MXD6 | MXD6 | 240 |
| Nylon 6/6T | Grivory | 295 |
| Polyphthalamide (PPA) | Zytel, LNP | 300 |

-continued

| Polymer | Trade Name | Melting Temperature, ° C. |
|---|---|---|
| Nylon 6T | Arlen | 310 |
| Nylon 6I/6T | Grivory | 325 |
| Polyamideimide | Torlon | 355 |

The partially aromatic polyamides may also include co-polymers or mixtures of multiple partially aromatic amides. For example, MXD6 can be blended with Nylon 6/6T prior to forming a fiber. Furthermore, partially aromatic polymers may be blended with an aliphatic polyamide or co-polymers or mixtures of multiple aliphatic polyamides. For example, MXD6 can be blended with Nylon 6,6 prior to forming a fiber.

The partially aromatic fiber can be a staple fiber or continuous filament yarn. The partially aromatic fiber can also be contained in a nonwoven fabric such as spun bond, melt blown, or a combination thereof. The filament cross section can be any shape, including round, triangle, star, square, oval, bi-lobal, tri-lobal, or flat. Further, the filament can be textured using known texturing methods. As discussed above, the partially aromatic polyamides spun into fibers can also include additional partially aromatic or aliphatic polymers. When spinning such fibers, a mixture of more than one polyamide polymer may be blended prior to spinning into yarn or a multi-filament yarn may be produced containing at least one partially aromatic polyamide polymer and an additional partially aromatic polyamide polymer or aliphatic polymer in a bicomponent form such as a side-by-side or core-sheath configuration.

The partially aromatic fiber will be combined with an FR fiber having significant vapor phase action such as modacrylic or FR cellulose fibers to form the primary yarn. The yarn may include only the partially aromatic fiber and the FR fiber; alternatively other fibers which are FR or non-FR fibers may be included. The useful amount of partially aromatic fiber varies. Suitable amounts of partially aromatic fiber include about 5% to about 75% by weight of the primary yarn; about 5% to about 60% by weight of the yarn; and about 25% to about 50% by weight of the yarn. The combined yarn may be prepared by any suitable method. For example, the yarn may be a blended staple yarn. The blended staple yarn may be an intimate blend in which the partially aromatic fiber and FR fiber are uniformly blended throughout the yarn. Alternatively, the yarn may be a single or ply twisted yarn, a covered yarn (including single and double covering) or a core-spun yarn, among others.

The primary yarn must include at least one FR fiber which is and has significant vapor phase action such as modacrylic or FR cellulose fibers, and combinations thereof. The FR fiber may also be FR cellulose where an FR additive is added to the FR cellulose during fiber manufacturing. Alternatively, an FR treatment may be applied to the article including an untreated cellulosic fiber. Examples of suitable cellulosic fibers include cotton, rayon or lyocell. Articles that include FR cellulose are meant to include those in which a constituent element, such as a yarn, is treated prior to incorporation into an article. Articles that include FR cellulose are also meant to include those treated after combining the cellulose into a yarn, as well as those treated after the yarns have been made into fabric or garments. As used herein, cellulose includes, but is not limited to, acetate, cotton, rayon, lyocell, and combinations thereof. In the primary yarn, one or more cellulosic fibers can be combined with each other and/or with modacrylic. The amounts of FR fiber having significant vapor phase action may vary. Suitable amounts of this fiber include about 25% to about 75% by weight of the primary yarn; greater than 25% to about 75% by weight of the yarn; about 40% to about 60% by weight of the yarn; and about 50% to about 75% by weight of the yarn.

The primary yarn may also include other FR fibers which are well-known in the art. Typically, these will be combined in a minor amount such as from 0 to about 50% based on the weight of the yarn. Other suitable amounts include greater than 0 such as greater than about 5%, greater than about 10% and up to about 30% by weight of the primary yarn. Examples include, but are not limited to, FR polyester, FR nylon, m-aramid, p-aramid, novoloid, melamine, poly(p-phenylene benzobisoxazole (PBO), polybenzimidazole (PBI), polysulphonamide (PSA), partially oxidized polyacrylonitrile (PAN) and combinations thereof.

The amount of the partially aromatic fiber in the primary yarn will depend on which FR fiber and/or other fibers (FR or non-FR) are also included in the yarn. For example, the partially aromatic polyamide fiber may be present in said primary yarn in an amount of about 5% to about 75% by weight of the primary yarn; alternatively the partially aromatic polyamide fiber may be present in said primary yarn in an amount of about 5% to about 60% by weight of the primary yarn. Other suitable ranges include where the minimum amount of partially aromatic fiber is about 25%; such as where the amount of partially aromatic fiber is about 25% to about 75% by weight of the primary yarn or about 25% to about 60% by weight of the primary yarn. The partially aromatic polyamide may also be present in an amount of about 40% to about 60% or about 50% by weight of the primary yarn. The type of FR fiber that accompanies the partially aromatic fiber will contribute to the necessary weight percent of each component based on the total weight of the primary yarn. When the primary yarn is included in a fabric, the fabric self-extinguishes in a vertical flammability test (ASTM D6416). Specifically, the article of one aspect is a fabric capable of having an after-flame time of less than about 10 seconds in a vertical flammability test.

Additional fibers which may be included within the primary yarn, in staple or filament form (depending on the fiber), both flame retardant and non-flame retardant, are useful for to form other yarns, fabrics and garments. The additional fibers can include cellulose (whether FR or not) such as cotton, rayon or lyocell, para-aramid, meta-aramid, modacrylic, melamine, poly(p-phenylene benzobisoxazole) (PBO), polybenzimidazole (PBI), polysulphonamide (PSA), oxidized acrylic, partially oxidized acrylic (including partially oxidized polyacrylonitrile), novoloid, wool, flax, hemp, silk, nylon (whether FR or not), polyester (whether FR or not), anti-static fibers, and combinations thereof. Certain fibers, such as para-aramid, PBI, or PBO, maintain strength after flame exposure and, when used in blended yarns and fabrics, are effective at reducing the fabric char length after flammability testing.

The article of one aspect may further include at least one additional yarn which is compositionally different from said primary yarn. "Compositionally different" means that the additional yarn differs from the primary yarn in at least one of a variety of aspects such as including different fiber compositions, different amounts of the same fibers, different fiber cross-section, different additives, different colors, etc. The article may further comprise at least two additional yarns which are compositionally different from each other and compositionally different from said primary yarn. Also, the additional yarn may be an FR yarn; or may be a non-FR yarn.

The fabrics made with the primary yarn can also include additional yarns such as cellulose (whether FR or not) including cotton, rayon or lyocell, para-aramid, meta-aramid, modacrylic, melamine, poly(p-phenylene benzobisoxazole) (PBO), polybenzimidazole (PBI), or polysulphonamide (PSA), oxidized acrylic, partially oxidized acrylic (including partially oxidized polyacrylonitrile), novoloid, wool, flax, hemp, silk, nylon (whether FR or not), polyester (whether FR or not), anti-static fibers, and combinations thereof.

Fabrics comprising non-FR celluloses can be treated with additional flame retardant additives and finishes if necessary. An exemplary method for treating cotton is found in the technical bulletin 'Fabric Flame Retardant Treatment' (2003) published by Cotton Incorporated, Cary, N.C., herein incorporated by reference in its entirety. The fabrics can be woven, knit, and non-woven fabrics. Non-woven fabrics include those made from carded webs, wet-lay, or spun bond/melt blown processes.

The fibers, yarns, and fabrics can also contain additional components such as: UV stabilizers, anti-microbial agents, bleaching agents, optical brighteners, anti-oxidants, pigments, dyes, soil repellants, stain repellants, nanoparticles, and water repellants. UV stabilizers, anti-microbials agents, optical brighteners, anti-oxidants, nanoparticles, and pigments can be added to the flame retardant polymer prior to melt-spinning or added as a post-treatment after fiber formation. Dyes, soil repellants, stain repellants, nanoparticles, and water repellants can be added as a post-treatment after fiber and/or fabric formation. Fabrics made with the disclosed flame retardant fiber may also have a coating or laminated film applied for abrasion resistance or for control of liquid/vapor permeation.

DEFINITIONS

After flame means: "Persistent flaming of a material after ignition source has been removed." [Source: ATSM D6413-11 *Standard test Method for Flame Resistance of Textiles* (*Vertical Method*)]

Char length means: "The distance from the fabric edge, which is directly exposed to flame to the furthest of visible fabric damage, after a specified tearing force has been applied." [Source: ATSM D6413-11 *Standard test Method for Flame Resistance of Textiles* (*Vertical Method*)]

Drip means: "A flow of liquid that lacks sufficient quantity or pressure to form a continuous stream." [Source: National Fire Protection Association (NFPA) Standard 2112, 2007 Edition, *Standard on Flame-Resistant Garments for Protection of industrial Personnel Against Flash Fire]*.

Melt means: 'The response to heat by a material resulting in evidence of flowing or dripping.' [Source: National Fire Protection Association (NFPA) Standard 2112, 2007 Edition, *Standard on Flame-Resistant Garments for Protection of industrial Personnel Against Flash Fire]*.

Self-Extinguishing means: Material will have no persistent flaming after the ignition source is removed OR flaming shall stop before the specimen is totally consumed. When tested by ATSM D6413-11 *Standard test Method for Flame Resistance of Textiles* (*Vertical Method*).

EXAMPLES

Test Methods

Flame retardancy was determined in accordance with ASTM D-6413-11 *Standard Test Method for Flame Resistance of Textiles* (*Vertical Test*).

Two sets of experiments were conducted as shown in Tables 1 and 2. Each of the fabrics, inventive and comparative (as indicated), was knit from yarns according to the indicated fiber blends. Afterflame is indicated in seconds and char length is measured in inches (in). Comparative examples are indicated by examples 1-5, 8-21, 26 and 30-35. Inventive examples, where MXD6 fibers were spun without FR additives, are indicated by examples 6-7, 22-25, 27-29, and 36-46.

Table 1 Examples: Filament MXD6 yarns and other yarns were twisted with staple spun FR rayon yarns and knit into socks for flammability testing. Examples 6 and 7 reveal that fabric blends including up to 60% MXD6 fiber, have a slight after-flame but self-extinguish. By comparison, a similar blend wherein the MXD6 fibers are replaced with PA 66 (Example 4) or PA 6 (Example 5) burn completely and do not self-extinguish. [Note: Vertical flammability test specimens are 12 inches in length. A Char Length of 12 inches indicates complete burning of the specimen with no self-extinguishing behavior.]

Table 2 Examples: Intimate fiber mixtures including MXD6 and FR rayon or cotton staple fibers and an optional char strengthening fiber were blended and spun into staple fiber yarns. The yarns were then knitted into socks. In the case of the cotton blend composition, the fabric was FR treated using the ammonia-cured THP pre-condensate system, commonly referred to as the 'Proban' process. All fabrics were tested for vertical flammability. Examples 22-24, 27-28 and 39-46 show that a yarn including an intimate blend of up to 50% MXD6 fibers with either FR rayon or FR-treated cotton fibers self-extinguish. Examples 25 and 29 demonstrate that greater amounts of MXD6 (up to about 75% or greater) may be useful depending on the companion FR cellulose fiber. By contrast, comparative examples 15-20 demonstrate that yarns including an intimate blend of greater than 25% by weight nylon 66 fibers burn. Examples 39-46 show that a second FR fiber such as p-aramid, oxidized polyacrylonitrile, or melamine fiber can be used as a fiber component to help reduce fabric Char Lengths from a vertical flammability test.

In Table 2, the fiber indicated as Ox. PAN is an oxidized polyacrylonitrile fiber commercially available as PYRON® fiber from Zoltek Corp., St. Louis, Mo. Other Ox. PAN fibers including those commercial available as TECGEN® fiber from Ashburn Hill Corp., Greenville, S.C. The fiber indicated as melamine is commercially available as BASOFIL® fiber manufactured by Basofil Fibers LLC, Hickory, N.C.

Each of the Examples which show yarns including a blend of partially aromatic fiber (MXD6) with one or more companion FR fiber are included as inventive examples.

TABLE 1

Examples: Vertical Flammability of Fabrics Comprising Twisted Yarns

| Ex. | Yarn A | % | Yarn B | % | Afterflame (s) | Char length (in) |
|---|---|---|---|---|---|---|
| 1 | Polyamide 66 | 100 | None | 0 | 0.0 | 4.0 |
| 2 | MXD6 | 100 | None | 0 | 0.0 | 4.3 |
| 3 | FR Rayon | 100 | None | 0 | 0.0 | 6.7 |
| 4 | Polyamide 66 | 50 | FR Rayon | 50 | 33.2 | 12.0 |
| 5 | Polyamide 6 | 50 | FR Rayon | 50 | 44.0 | 12.0 |
| 6 | MXD6 | 50 | FR Rayon | 50 | 3.0 | 4.3 |
| 7 | MXD6 | 60 | FR Rayon | 40 | 5.0 | 5.7 |

By comparing Examples 1 and 2 one sees that while all of the socks containing only thermoplastic yarns have no After Flame. The explanation is that in a vertical flammability test, all of these pure thermoplastic fabrics will shrink away from and are not truly exposed to the flame. However, when blended with a flame resistant fiber which will not shrink away from a flame, the advantage of the invention is seen. In Table 1, Examples 6 and 7 show that plied yarns including up to about 60% MXD6 filament yarn and FR rayon staple spun yarn fiber will self-extinguish, whereas aliphatic polyamides 6 and 66 do not self-extinguish.

TABLE 2

Examples: Vertical Flammability of Fabrics Including Intimate Fiber Blended Yarn

| Ex. | Fiber A | % | Fiber B | % | Fiber C | % | Afterflame (s) | Char length (in) |
|---|---|---|---|---|---|---|---|---|
| 8 | Polyamide 66 | 100 | | | | | 0.0 | 4.3 |
| 9 | MXD6 | 100 | | | | | 0.0 | 3.6 |
| 10 | Para-aramid | 100 | | | | | 0.0 | 0.1 |
| 11 | Meta-aramid | 100 | | | | | 0.0 | 1.8 |
| 12 | FR cotton | 100 | | | | | 0.0 | 3.6 |
| 13 | FR rayon | 100 | | | | | 0.0 | 5.6 |
| 14 | FR polyester | 100 | | | | | 0.0 | 5.3 |
| 15 | Polyamide 66 | 25 | FR Rayon | 75 | | | 0.6 | 5.8 |
| 16 | Polyamide 66 | 50 | FR Rayon | 50 | | | 20.2 | 11.4 |
| 17 | Polyamide 66 | 75 | FR Rayon | 25 | | | 34.5 | 12.0 |
| 18 | Polyamide 66 | 25 | FR Cotton | 75 | | | 8.7 | 7.9 |
| 19 | Polyamide 66 | 50 | FR Cotton | 50 | | | 27.1 | 10.4 |
| 20 | Polyamide 66 | 75 | FR Cotton | 25 | | | 37.8 | 11.8 |
| 21 | FR Rayon | 50 | FR polyester | 50 | | | 36.4 | 12.0 |
| 22 | MXD6 | 25 | FR Rayon | 75 | | | 0.0 | 6.2 |
| 23 | MXD6 | 50 | FR Rayon | 50 | | | 0.0 | 5.4 |
| 24-Dyed | MXD6 | 50 | FR Rayon | 50 | | | 0.0 | 5.3 |
| 25 | MXD6 | 75 | FR Rayon | 25 | | | 25.7 | 12.0 |
| 26 | MXD6 | 50 | Cotton | 50 | | | 29.0 | 12.0 |
| 27 | MXD6 | 25 | FR Cotton | 75 | | | 0 | 5.8 |
| 28 | MXD6 | 50 | FR Cotton | 50 | | | 0 | 5.2 |
| 29 | MXD6 | 75 | FR Cotton | 25 | | | 7.6 | 7.9 |
| 30 | MXD6 | 25 | m-aramid | 75 | | | 38.4 | 12 |
| 31 | MXD6 | 50 | m-aramid | 50 | | | 36.2 | 12 |
| 32 | MXD6 | 75 | m-aramid | 25 | | | 54.5 | 12 |
| 33 | MXD6 | 25 | p-aramid | 75 | | | 33.6 | 0.3 |
| 34 | MXD6 | 50 | p-aramid | 50 | | | 44.6 | 1.7 |
| 35 | MXD6 | 75 | p-aramid | 25 | | | 63.8 | 12 |

TABLE 2-continued

Examples: Vertical Flammability of Fabrics Including Intimate Fiber Blended Yarn

| Ex. | Fiber A | % | Fiber B | % | Fiber C | % | Afterflame (s) | Char length (in) |
|---|---|---|---|---|---|---|---|---|
| 36 | MXD6 | 25 | Modacrylic | 75 | | | 0 | 4.8 |
| 37 | MXD6 | 50 | Modacrylic | 50 | | | 0 | 5.9 |
| 38 | MXD6 | 75 | Modacrylic | 25 | | | 8 | 5.2 |
| 39 | MXD6 | 50 | FR Cotton | 35 | p-aramid | 15 | 0 | 2.1 |
| 40 | MXD6 | 50 | FR Cotton | 40 | p-aramid | 10 | 0 | 2.8 |
| 41 | MXD6 | 50 | FR Rayon | 40 | p-aramid | 10 | 0 | 6.6 |
| 42 | MXD6 | 50 | FR Cotton | 45 | Ox. PAN | 5 | 0 | 5.9 |
| 43 | MXD6 | 50 | FR Cotton | 40 | Ox. PAN | 10 | 3.6 | 8.6 |
| 44 | MXD6 | 50 | FR Cotton | 40 | Melamine | 10 | 0 | 4.9 |
| 45 | MXD6 | 60 | FR Cotton | 30 | Melamine | 10 | 0.7 | 3.7 |
| 46 | MXD6 | 70 | FR Cotton | 20 | p-aramid | 10 | 2.3 | 5 |

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. An article exhibiting flame resistant or flame retardant property comprising a primary yarn; wherein said primary yarn comprises a flame resistant or flame retardant (FR) fiber having vapor phase action and a fiber different from said flame resistant or flame retardant fiber comprising a partially aromatic polyamide fiber; wherein said partially aromatic polyamide is spun into fiber without FR additives; and wherein said article is capable of self-extinguishing.

2. The article of claim 1, wherein the partially aromatic polyamide comprises polymers or copolymers comprising monomers selected from the group consisting of aromatic diamine monomers, aliphatic diamine monomers, aromatic diacid monomers, aliphatic diacid monomers and combinations thereof.

3. The article of claim 2, wherein the partially aromatic polyamide further comprises aromatic diamine monomers and aliphatic diacid monomers.

4. The article of claim 1, wherein the partially aromatic polyamide is MXD6.

5. The article of claim 1, wherein said partially aromatic polyamide fiber is in staple fiber form.

6. The article of claim 1, wherein said partially aromatic polyamide fiber is in continuous filament form.

7. The article of claim 1, wherein said partially aromatic polyamide fiber is a flat fiber.

8. The article of claim 1, wherein said primary yarn is a twisted yarn or ply-twisted yarn.

9. The article of claim 1, wherein said primary yarn is a textured yarn.

10. The article of claim 5, wherein said primary yarn is a blended staple yarn.

11. The article of claim 1, wherein said partially aromatic polyamide fiber is present in said primary yarn in an amount of about 5% to about 75% by weight of the primary yarn.

12. The article of claim 1, wherein said partially aromatic polyamide fiber is present in said primary yarn in an amount of about 5% to about 60% by weight of the primary yarn.

13. The article of claim 11, wherein said primary yarn includes only said partially aromatic fiber and said FR fiber.

14. The article of claim 1, wherein said FR fiber having significant vapor phase action is selected from modacrylic fiber, FR cellulose fiber, and combinations thereof.

15. The article of claim 1, wherein said primary yarn further includes an additional FR fiber selected from the group consisting of FR polyester, FR nylon, FR rayon, m-aramid, p-aramid, modacrylic, novoloid, melamine, poly (p-phenylene benzobisoxazole (PBO), polybenzimidazole (PBI), polysulphonamide (PSA), oxidized acrylic, partially oxidized acrylic, and combinations thereof.

16. The article of claim 1, wherein said FR fiber comprises FR cellulose fiber wherein an FR treatment is selected from the group consisting of (a) application to said FR cellulose fiber, (b) incorporation into said FR cellulose fiber during fiber spinning and (c) topical application of an FR treatment to said article comprising untreated cellulosic fiber.

17. The article of claim 1, further comprising an additional non-FR fiber.

18. The article of claim 1, wherein said article is a yarn.

19. The article of claim 1, wherein said article is a fabric.

20. The article of claim 1, wherein said article is a garment.

21. The article of claim 1, further comprising at least one additional yarn which is compositionally different from said primary yarn.

22. The article of claim 1, further comprising at least two additional yarns which are compositionally different from each other and compositionally different from said primary yarn.

23. The article of claim 21, wherein said additional yarn is an FR yarn.

24. The article of claim 21, wherein said additional yarn is a non-FR yarn.

25. The article of claim 1, wherein said article is a fabric capable of self-extinguishing and having an After Flame time of less than about 10 seconds in a vertical flammability test.

26. The article of claim 18, wherein said article is dyed.

27. The article of claim 19, wherein said article is dyed.

28. The article of claim 19, wherein said article is printed.

* * * * *